US006371473B1

(12) United States Patent
Saltsov et al.

(10) Patent No.: US 6,371,473 B1
(45) Date of Patent: Apr. 16, 2002

(54) COMBINATION BANKNOTE VALIDATOR AND BANKNOTE DISPENSER

(75) Inventors: Leon Saltsov, Thronhill; Sergiy Bukhman, Toronto, both of (CA); Olexsandr Onipchenko, Kyiv (UA); Boris Gisar, Kyiv (UA); Sergiy Androsyuk, Kyiv (UA)

(73) Assignee: Cashcode Company Inc., Concord (CA)

( * ) Notice: Subject to any disclaimer, the term of this patent is extended or adjusted under 35 U.S.C. 154(b) by 0 days.

(21) Appl. No.: 09/575,242

(22) Filed: May 22, 2000

(30) Foreign Application Priority Data

Mar. 2, 2000 (CA) ..... 2299827

(51) Int. Cl.[7] ..... B65H 5/22
(52) U.S. Cl. ..... 271/3.01; 194/206
(58) Field of Search ..... 271/3.01, 3.14; 194/225, 302, 342, 346, 206

(56) References Cited

U.S. PATENT DOCUMENTS

| | | | | |
|---|---|---|---|---|
| 3,924,847 A | * | 12/1975 | Pescetto | |
| 4,746,110 A | * | 5/1988 | Chiba | 271/3.01 |
| 4,889,240 A | * | 12/1989 | Sato et al. | 271/3.01 |
| 5,135,212 A | * | 8/1992 | Utsumi et al. | 271/3.01 |
| 5,730,271 A | * | 3/1998 | Buchman et al. | 194/206 |
| 5,927,936 A | * | 7/1999 | Arikawa et al. | 194/346 X |
| 5,993,317 A | * | 11/1999 | Majima | 194/206 X |

* cited by examiner

*Primary Examiner*—David H. Bollinger

(57) ABSTRACT

A combination banknote validator, banknote accumulator, banknote storage cassette and banknote dispenser is designed in a modular manner and the accumulator and banknote dispenser cooperate to additionally define part of a processing pathway therebetween. The banknotes can move in either direction along the processing pathway and preferably several accumulators are located along the pathway. The banknote dispenser is of a rotary design and stacks banknotes on the surface thereof and dispenses a stack of banknotes through a discharge opening.

6 Claims, 18 Drawing Sheets

COMBINATION BANKNOTE VALIDATOR AND BANKNOTE DISPENSER

BACKGROUND OF THE INVENTION

The present invention relates to banknote validators which are additionally designed to selectively store received banknotes in a manner to allow later dispensing thereof.

Banknote validators are widely used in vending machine applications as well as other machines designed for financial transactions. These validators receive a banknote and conduct an evaluation to determine the denomination and authenticity of the banknote. If the banknote is accepted, it is normally stored in a removable cassette and the user is provided with an appropriate credit with respect to the vending machine.

It has also been known to combine a banknote validator with a banknote dispensing unit. The banknote dispensing unit allows dispensing of banknotes which have been previously stored in the device. Banknotes received by the validator are separately stored in the removable banknote cassette and are not fed to the banknote dispensing unit. Basically, these type of machines are serviced on a frequent basis and the banknote dispensing units are charged with a new supply of banknotes.

An automatic teller machine is disclosed in U.S. Pat. No. 5,135,212 where received banknotes are temporarily stored for later dispensing. Banknotes of a predetermined denomination are temporarily stored in an accumulator and subsequently dispensed as required.

One of the problems associated with banknote validators is the small space allowed in vending or gaming machines for receiving a banknote acceptor and/or banknote dispenser. In addition, banknote validators with an accumulator have not been particularly reliable and frequent service becomes a problem. Stand alone combined banknote acceptors and dispensers are not space efficient and unacceptable to businesses requiting a high dollar revenue per square foot of retailing space.

The present invention overcomes a number of these problems with respect to the prior art structures.

SUMMARY OF THE INVENTION

A combination bill validator, bill accumulator and bill dispensing unit according to the present invention comprises in combination a validator for receiving banknotes and evaluating banknotes and forwarding accepted banknotes to a processing pathway, and a series of modular components which cooperate to define the banknote processing pathway therebetween. The series of modular components include a banknote accumulator for receiving and temporarily storing received banknotes and outputting received banknotes to the processing pathway, a removable banknote cassette for receiving and storing banknotes in a stacked manner, and a banknote dispenser which receives banknotes from the pathway and discharges received banknotes through a discharge port. The processing pathway is defined by at least some of the modular components and at least one of the modular components includes a drive arrangement located in the pathway for engaging and driving a banknote along the pathway.

The combination unit according to an aspect of the invention locates the modular components in opposed pairs of modular components with the pathway therebetween and the drive arrangement of each opposed pair cooperate to drive a banknote along the processing pathway.

According to a further aspect of the invention each modular component each includes an additional banknote drive for driving within said modular component and from each modular component.

The combination unit according to yet a further aspect of the invention locates the banknote dispenser opposite the banknote accumulator with said processing pathway therebetween, and the series of modular components include two additional banknote accumulators in opposed relationship and defining said pathway therebetween.

The combination unit according to a different aspect of the invention includes a separate controller and processing arrangement and wherein said modular components are all controlled by said separate controller and processing arrangement.

A modular component according to the present invention is used in combination with a banknote validator. The modular component includes a generally straight wall section having a first banknote drive arrangement projecting outwardly therefrom for engaging a banknote and driving said banknote along a path generally parallel to said straight wall section, said modular component including a banknote opening through which banknotes are received into said component and an arrangement for discharging banknotes from the component. The modular component includes a second banknote drive arrangement interior to said component which drives received banknotes within said modular component during receipt and discharge of a banknote from the component.

The modular component according to an aspect of the invention is a banknote accumulator for receiving banknotes for temporary storage and dispensing of received banknotes through a banknote opening and wherein said banknote opening forms part of said arrangement for discharging banknotes and banknotes are discharged through said opening.

The modular component according to an aspect of the invention includes a projecting drive member at one edge of said straight wall section and an idler member at an opposite edge of said straight wall section and wherein the projecting drive member and said idler member form part of said drive arrangement.

The modular component according to a further aspect of the invention is operable in one two orientations on opposite sides a banknote processing pathway.

The banknote dispenser according to an aspect of the invention receives and stacks banknotes received from said pathway and the discharge arrangement dispenses a stack of banknotes through a discharge port.

The banknote dispenser according to a further aspect of the invention includes a rotary accumulator upon which banknotes are stacked and from which stacked banknotes are dispensed.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
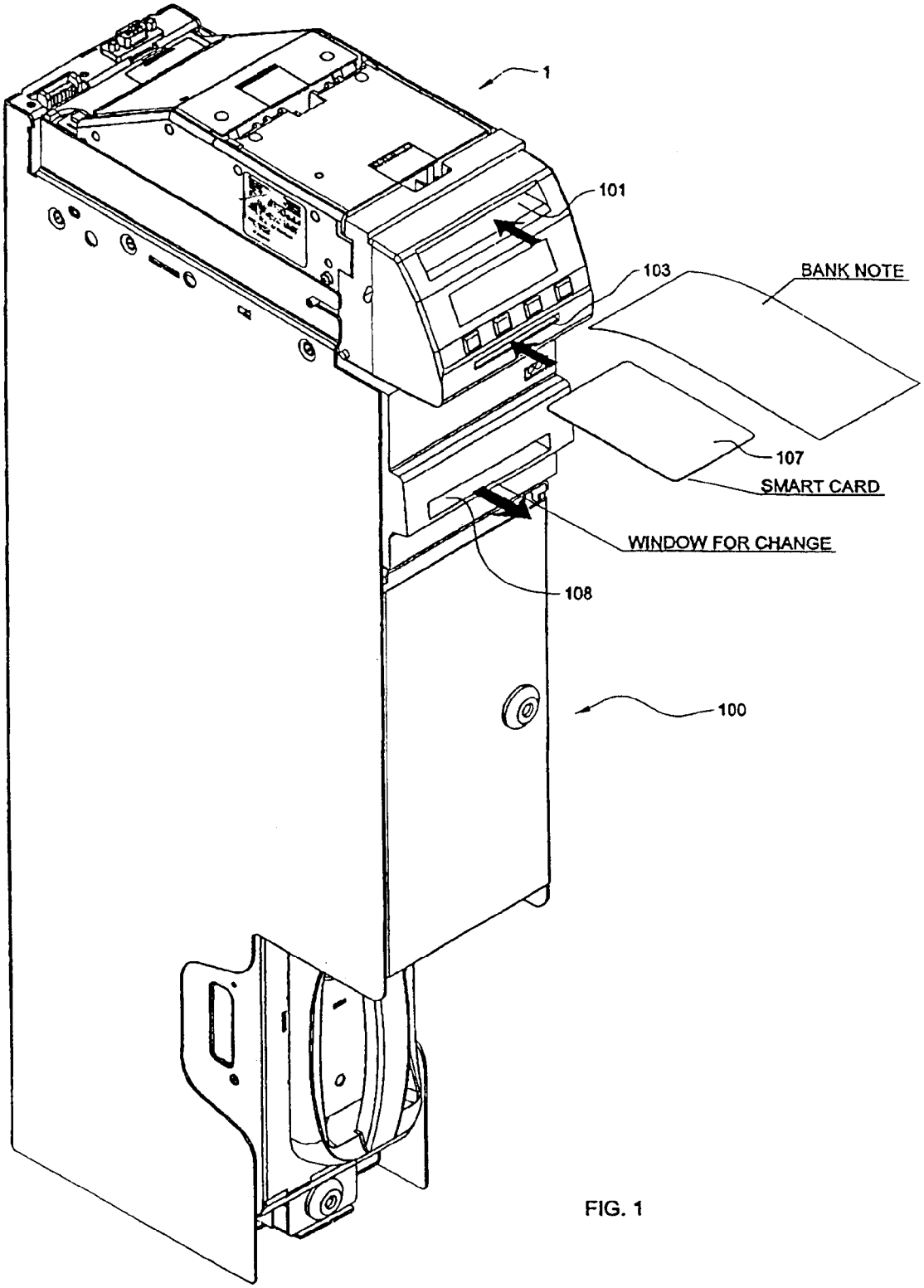
FIG. 1 is a perspective view of a combination unit for evaluating, storing and dispensing banknotes.
Figure 1A:
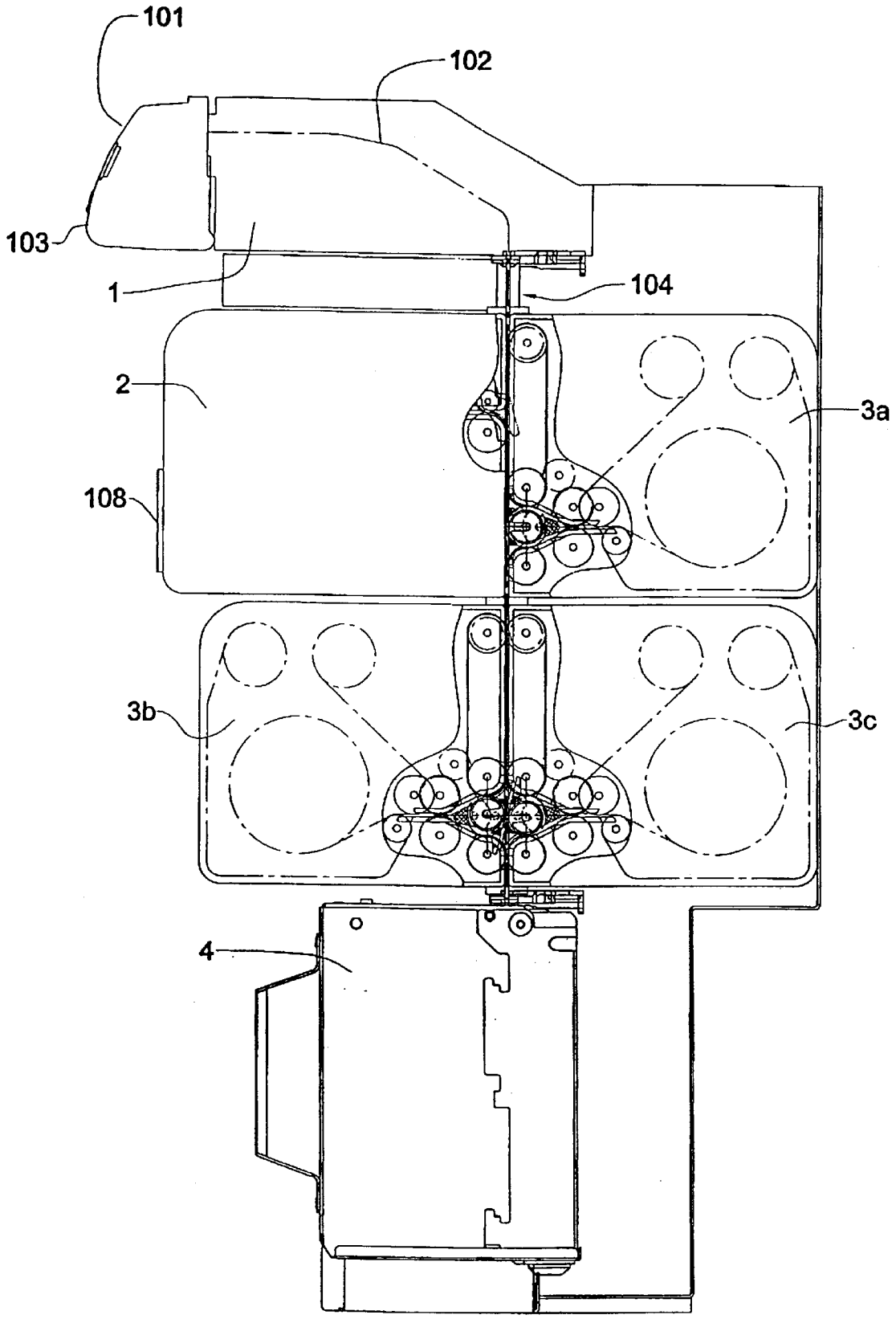
FIG. 1*a* is a partial side view with a partial cut away to show a combination validator and dispenser.
Figure 2:
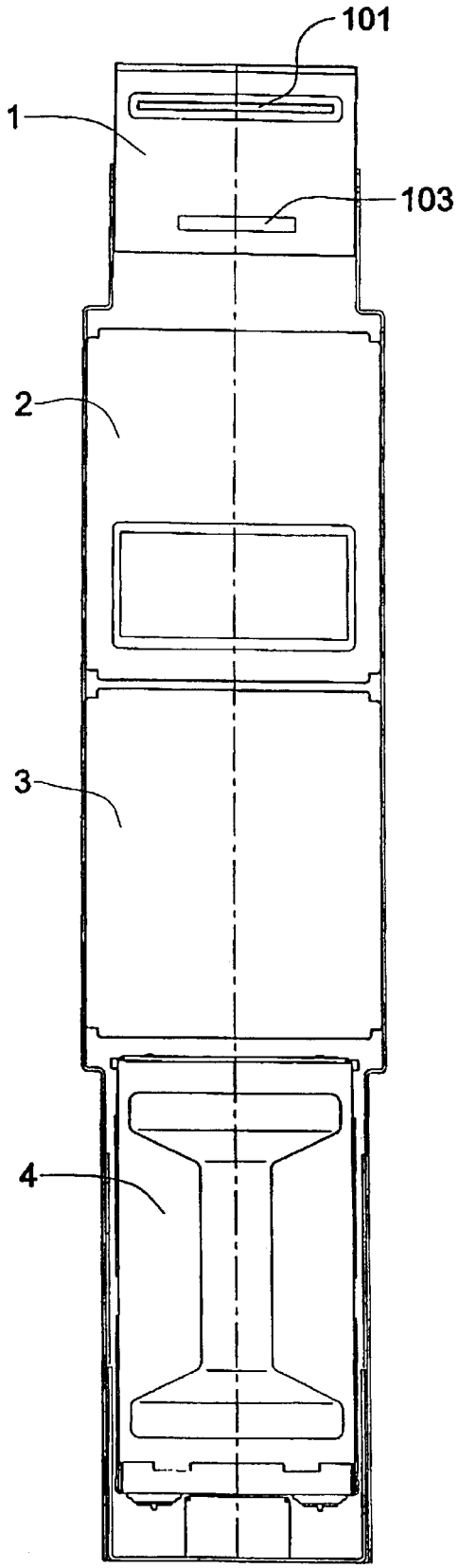
FIG. 2 is a front view of the combined unit of FIG. 1*a;*

The combination unit 1*a* of FIG. 100 has a validator 1 for receiving of banknotes through the slot for and processing the banknotes along a pathway indicated as 102. If the banknote is acceptable, it leaves the validator 1 and is fed into the processing pathway 104. This processing pathway 104 is a vertical pathway and transports a received banknote between the stacking and dispensing unit 2, a first banknote accumulator 3*a,* and subsequently, passed opposed banknotes accumulators 3*b* and 3*c,* and finally, to the banknote receiving cassette 4. The pathway 104 is preferably defined between the opposed modular units, namely; opposed devices 2, 3*a,* 3*b* and 3*c*. In this case, the various devices also perform a transportation function for moving received banknotes between the devices.

The banknotes are driven along the path 104 and diverted from the pathway into one of the modular units by controlled path diverters. The banknote stacker 2 is designed to receive banknotes which have been previously accumulated and forwarded to the stacker from one of the accumulators 3 along path 104. Thus, the drive path 104 is by-directional. A received banknote can also be directly processed to the removable banknote storage cassette 4. In this case the banknote is not returnable to the pathway and is removed from the unit when the cassette is removed.

The banknote cassette 4 is removable from the combination unit and a replaceable banknote cassette is easily inserted or the cassette can be emptied and reinstalled.

The combination unit 100 can also receive a smart card, debit card or credit card through slot 103 which has been combined with the validator 1. The validator 1 includes a separate card reader, and processor circuit which is essentially independent of the validator. The card processor and the validator preferably share a common power supply and perhaps a common interface board.

The banknote accumulators 3*b* and 3*c* are of an identical construction and form an opposed pair appropriately positioned on opposite sides of the pathway 104. Accumulator 3*a* is identical to unit 3*c*. Thus, all of these accumulators are of the identical design and are replaceable, one with the other. Banknotes forwarded from the validator 1 to path 104 move downwardly and the validator 1 provides information with respect to the denomination of the particular banknote received and accepted. Banknote accumulator 3*a* may accumulate $5.00 banknotes, accumulator 3*b* may accumulate $1.00 banknotes and accumulator 3*c* may accumulate $10.00 banknotes as one example. The combination unit can be programmed to change the denomination of the banknotes stored. In the case of gaming machines it may be desirable for one accumulator to store large denomination bills which can be dispensed if there is a large payout.

A decision can be made whether the accepted banknote is to be stored in one of the three accumulators. If so, a toggle member 116 of the appropriate accumulator is moved to intercept and guide the banknote from path 104 into the accumulator. The toggle member associated with each accumulator provides at least two paths for entering or exiting the accumulator. With this arrangement a banknote can be directed to the accumulator when moved downwardly along path 104 or when the banknote is moved upwardly along path 104.

With this arrangement, it is also possible to use one of the banknote accumulators, such as accumulator 3*a* as an escrow accumulator. For example, a user might enter five or six banknotes into the validator for a particular transaction and these banknotes are fed from the validator to the escrow accumulator 3*a*. The combination unit keeps track of the number of banknotes fed to the accumulator and the value thereof. If the transaction is terminated, either due to insufficient funds or based on instructions from the user, the same banknotes received from the user and stored in the escrow accumulator 3*a* are sequentially returned to path 104 and transported to the stacking arrangement 2. The stacking arrangement 2 receives the banknotes from the escrow accumulator, stacks them one atop of the other and dispenses the stack through port 108. In this way, the identical banknotes are returned to the user.

Figure 3:
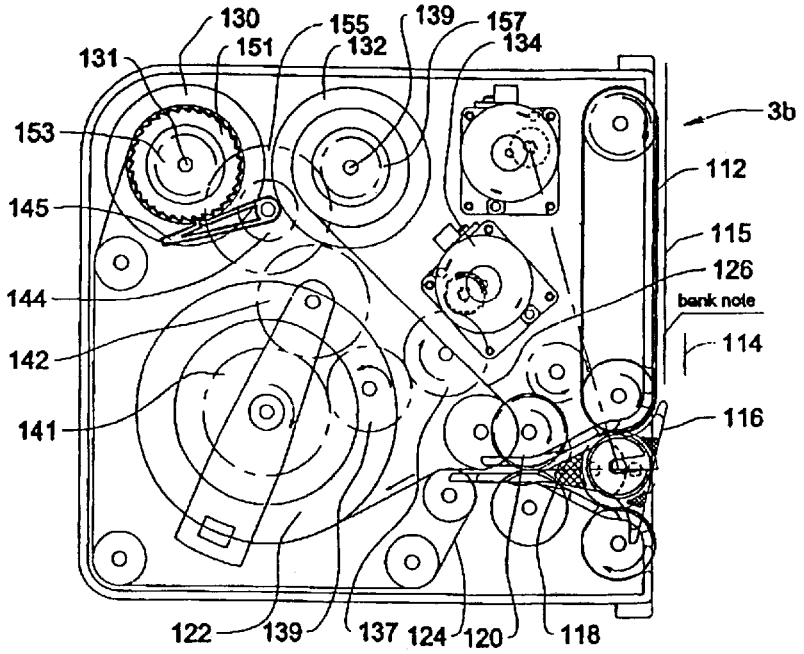
FIG. 3 is a side view of the banknote accumulator used in the validator.
Figure 4:
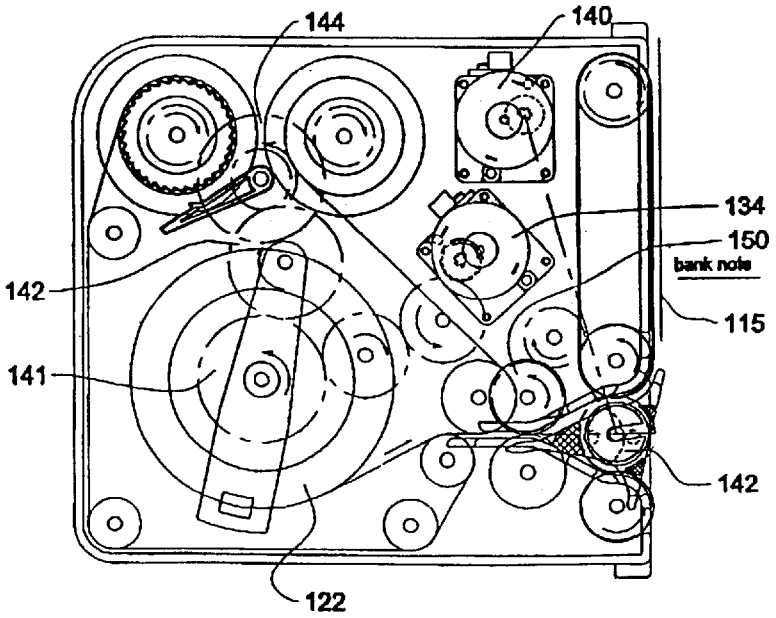
FIG. 4 is a view similar to FIG. 3 with the accumulator in a mode for dispensing of a banknote from the accumulator.

A better understanding of the operation of the banknote accumulator 3*b* can be appreciated from FIGS. 3 and 4. In FIG. 3 the belt drive 112 is rotated in a clockwise direction to drive a banknote as indicated by arrow 114. The toggle member 116 has been rotated clockwise to guide the banknote 115 into the accumulator 3*b*. The belt drive of the opposite accumulator 3*c* would also be driven but in a counter clockwise direction to provide the desired movement of the banknote as indicated in FIG. 3. The toggle 116 has been moved outwardly and extends across the path 104 and provides a curved guide surface for directing the banknote 115 into the processing channel 118 of the accumulator.

The banknote upon entering the accumulator engages the drive roller 120 and is fed onto the accumulator drum 122. The banknote has thin tape belt strips 124 and 126 applied to opposite sides of the banknote and these belt strips served to trap a banknote therebetween and separate the banknote from banknotes previously wound onto the accumulator drum 122 as well as separating the banknote from the banknotes which will be subsequently wound onto the accumulator drum.

To avoid problems such as skewing, the tapes are small strips approximately one inch in width, and two spaced tapes can be applied to each side of the banknote if desired. Tape 124 is pulled off the supply spool 130 which is slipping on shaft 131. Shaft 131 is being held against rotation by the ratchet paul 145 in engagement with the ratchet gear 151. The actual slippage is a two part arrangement as will be more fully explained in FIG. 11. There is a drag on the withdrawal of the tape to maintain some tension on the tape however the slippage automatically responds to the changing speed of the accumulator 122. As can be appreciated, the tape speed must respond to the changing diameter of the accumulator 122. This controlled slippage arrangement is simple and effective.

The supply reel 132 is also mounted for slippage on shaft 139. In addition shaft 131 and shaft 139 are connected by the gear train formed by gears 153,155 and 157. Thus locking of shaft 131 locks shaft 139.

Figure 11:
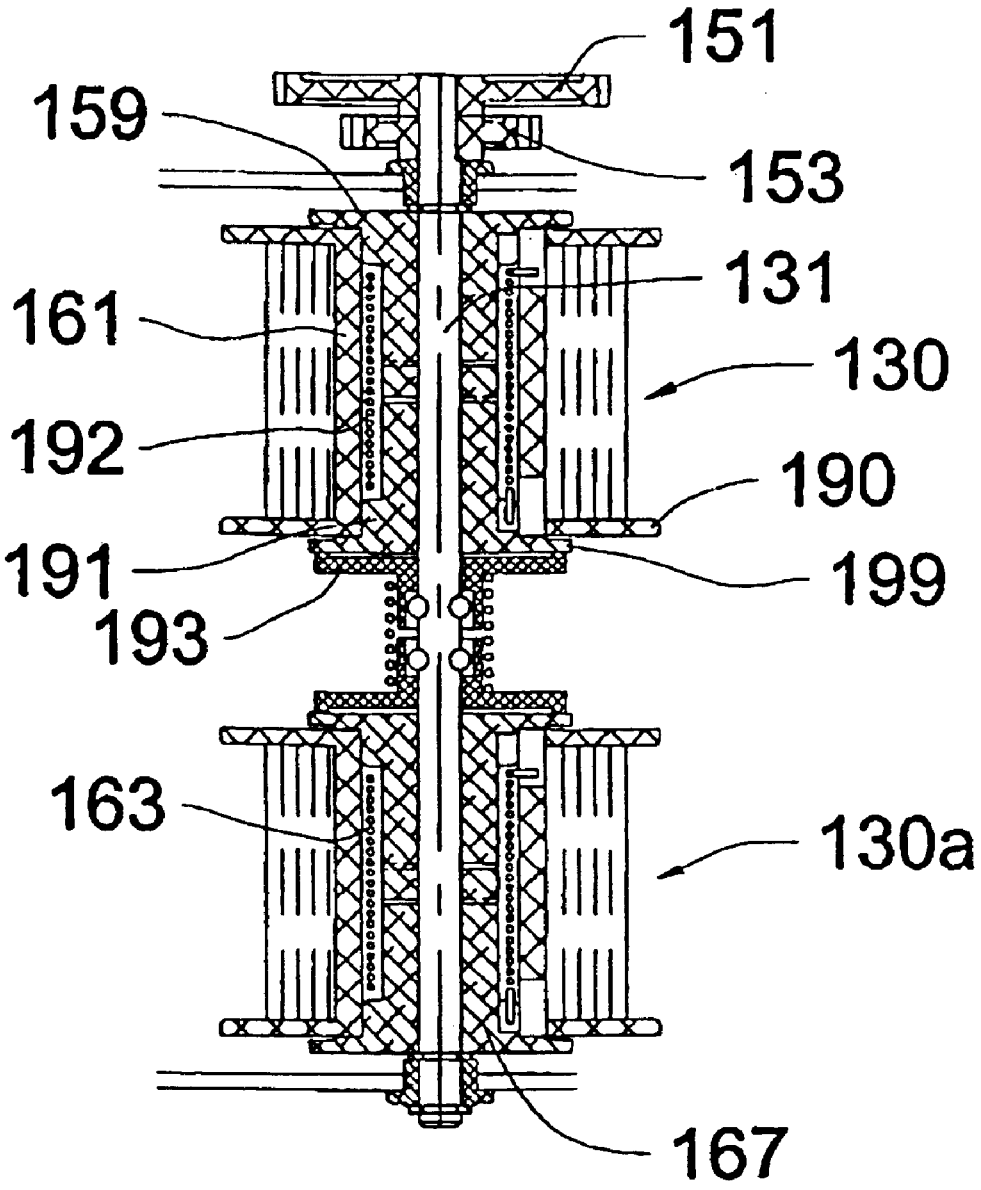
FIG. 11 shows details of two tape members used in the accumulator of FIGS. 3 and 4.

The preferred mounting of the tape spools can be understood from the sectional view of FIG. 11. The ratchet gear 151 and the drive gear 153 are fixed on the shaft 131. The spools 130 and 130*a* are of a three part construction including an outer reel 190, an inner reel 191 and a trapped torsion spring 192. One end of the torsion spring is attached to the outer reel and an opposite end of the torsion spring is attached to inner reel 191. With this arrangement the reels can partially rotate relative to each other until the torsion spring deforms sufficiently to temporarily lock the reels. The spools 130 and 131 are rotatable on shaft 131 while the inner reel 191 is in frictional engagement with drive spool 193. Drive spool 193 rotates with shaft 131 and encourages inner reel 191 to respond to movement of the drive spool through a spring loaded friction relationship. Spring 172 urges the drive spool 193 into contact with the flange 199 of the inner spool. These parts cooperate to form a spring loaded friction clutch.

When the accumulator receives a banknote as shown in FIG. 3, shaft 131 is stationary. The accumulator 122 pulls tape 124 and winds the tape with the banknote. Spool 130 initially responds by movement of the outer reel relative to the inner reel and loads the torsion spring 161. This provides a tension force to take up any slack in the tape 124. Eventually the inner spool starts slipping on the drive spool 193.

The motor 134 is reversible and drives the gear drive train to rotate the accumulator 122 clockwise in FIG. 3 or counterclockwise in FIG. 4. When the accumulator drum is driven as shown in FIG. 4 gear 142 rotates on gear 141 and engages gear 144 of the drive train associated with the tape spools. This gear train overdrives the spools to wind the tapes 124 and 126. The spools slip as required on the drive shafts when the tension in the tape overcomes the friction clutch. Thus the spools are driven at a sufficient rate to wind the tape onto the spools and the arrangement compensates in a simple manner for the changing speed of the tape being wound on accumulator drum.

FIG. 4 shows a banknote being dispensed from the accumulator. The accumulator is being driven in a counter clockwise direction and banknotes are being fed off the last banknote first, from the accumulator 122, to the discharge of the accumulator. In this case, the banknote is being transported upwardly as indicated by the banknote 115 and the direction of motion thereof. The toggle 116 again, is pivoted in a clockwise direction and the toggle is controlled by motor 140. The belt 112 is separately driven by an external motor.

Figure 5:
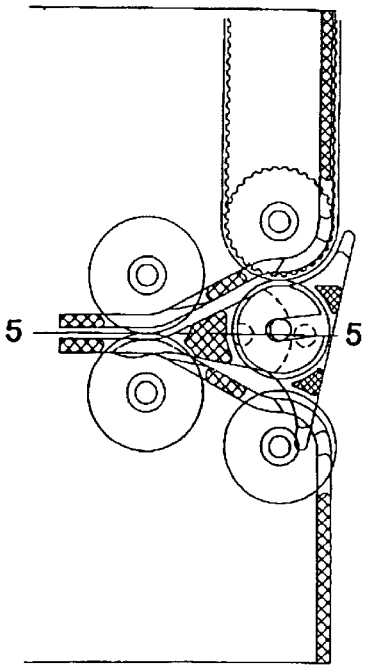
FIG. 5 is a partial section of a view showing details of one mechanism used to direct banknotes into or out of the accumulator.
Figure 7:
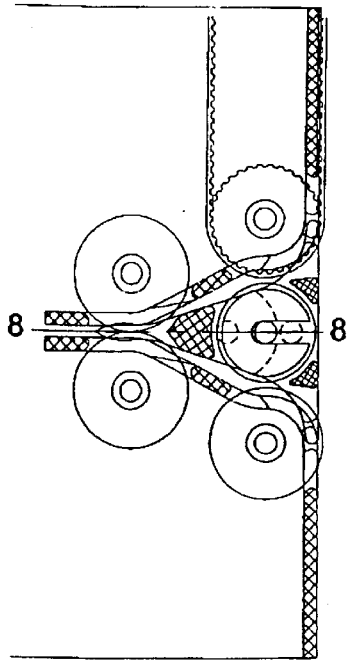
FIG. 7 is a view similar to FIG. 5 showing the accumulator in a bypass position.
Figure 9:
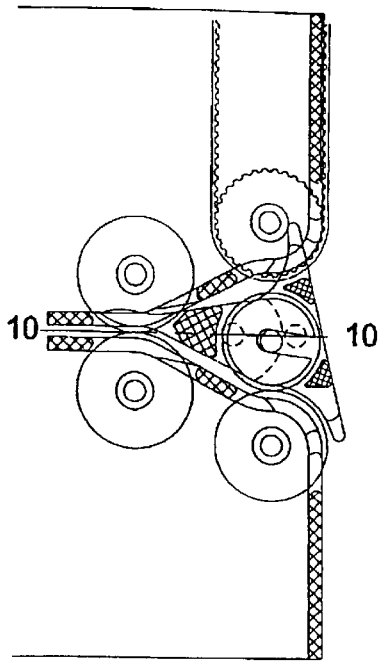
FIG. 9 is a partial side view showing movement of a toggle for receiving a banknote to the accumulator.

The vertical views of FIGS. 5, 7 and 9, show different positions of the toggle member 116. In FIG. 5 the toggle has been positioned for either entry to or dispensing from the accumulator if the dispensing direction is upwardly. In FIG. 7, the toggle has been moved to a bypass position and the banknote will move past this particular accumulator.

Figure 6:
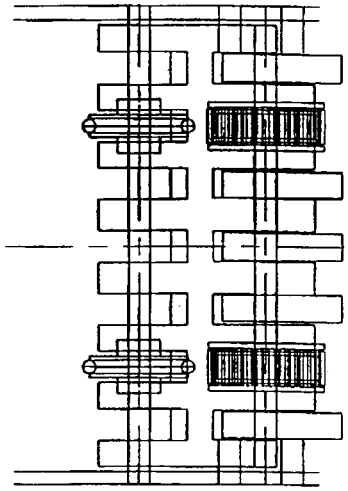
FIG. 6 is a sectional view along line 6—6 of FIG. 5.
Figure 8:
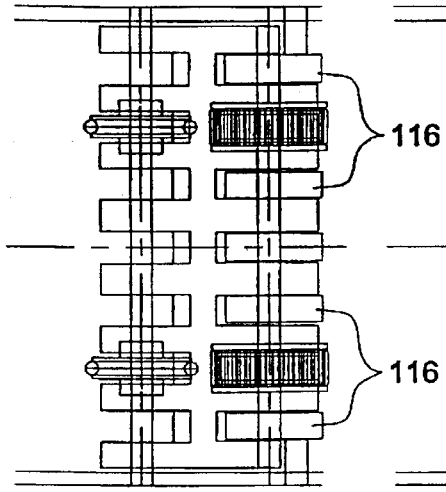
FIG. 8 is a sectional view along line 8—8 of FIG. 7.
Figure 10:
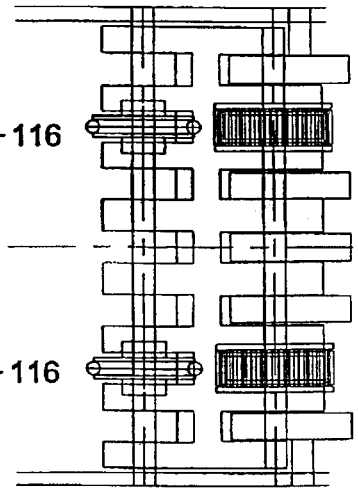
FIG. 10 is a sectional view along line 10—10 of FIG. 9.

In FIG. 9, the toggle 116 has been moved to a position for feeding out of the accumulator to a device below the accumulator or for feeding into the accumulator from below. As can be seen in the sectional views of FIGS. 6 and 10, the toggle member 116 interrupts the movement of the banknote and directs it into or out of the accumulator, whereas in FIG. 8, a banknote is free to move past toggle member 116.

Figure 12:
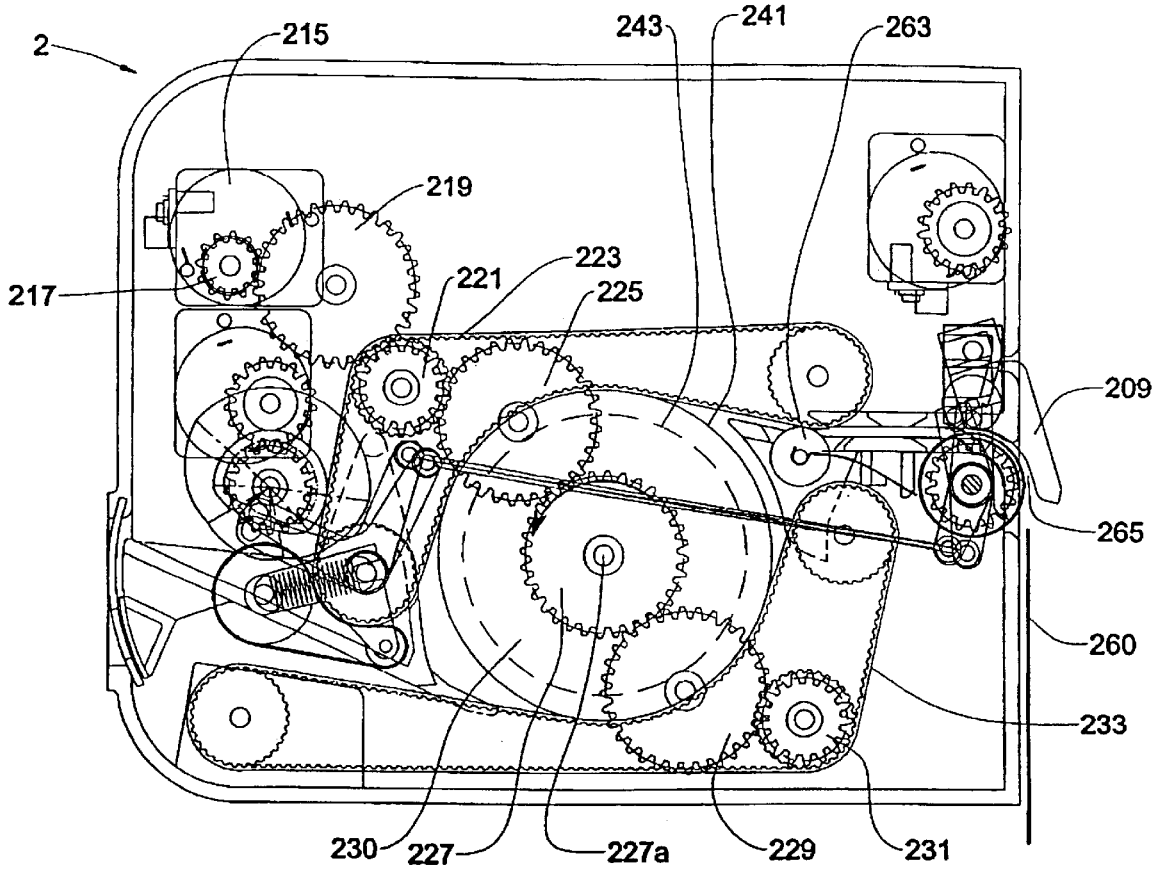
FIG. 12 is a sectional view through a stacking unit used to dispense a stack of banknotes.
Figure 13:
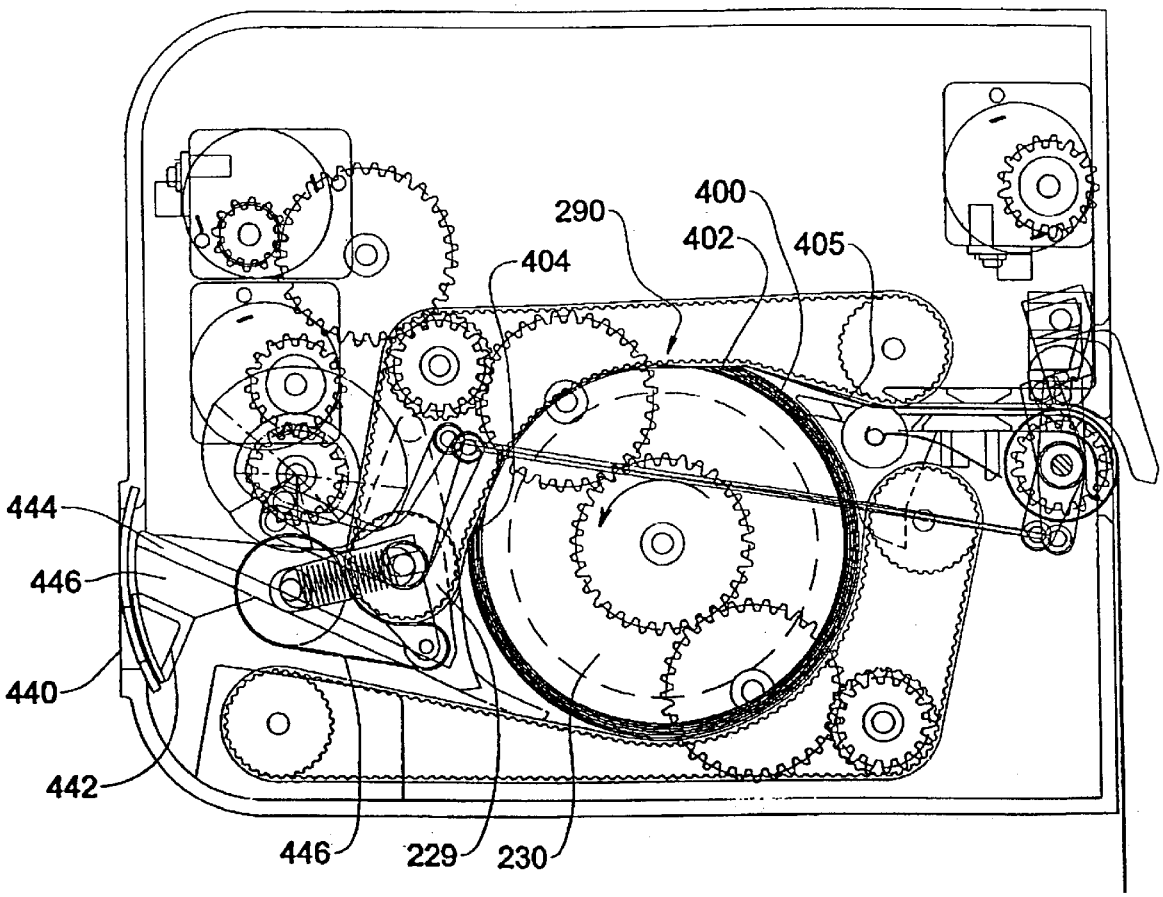
FIG. 13 is a view similar to FIG. 12 with a number of banknotes stacked on the rotary accumulator.
Figure 14:
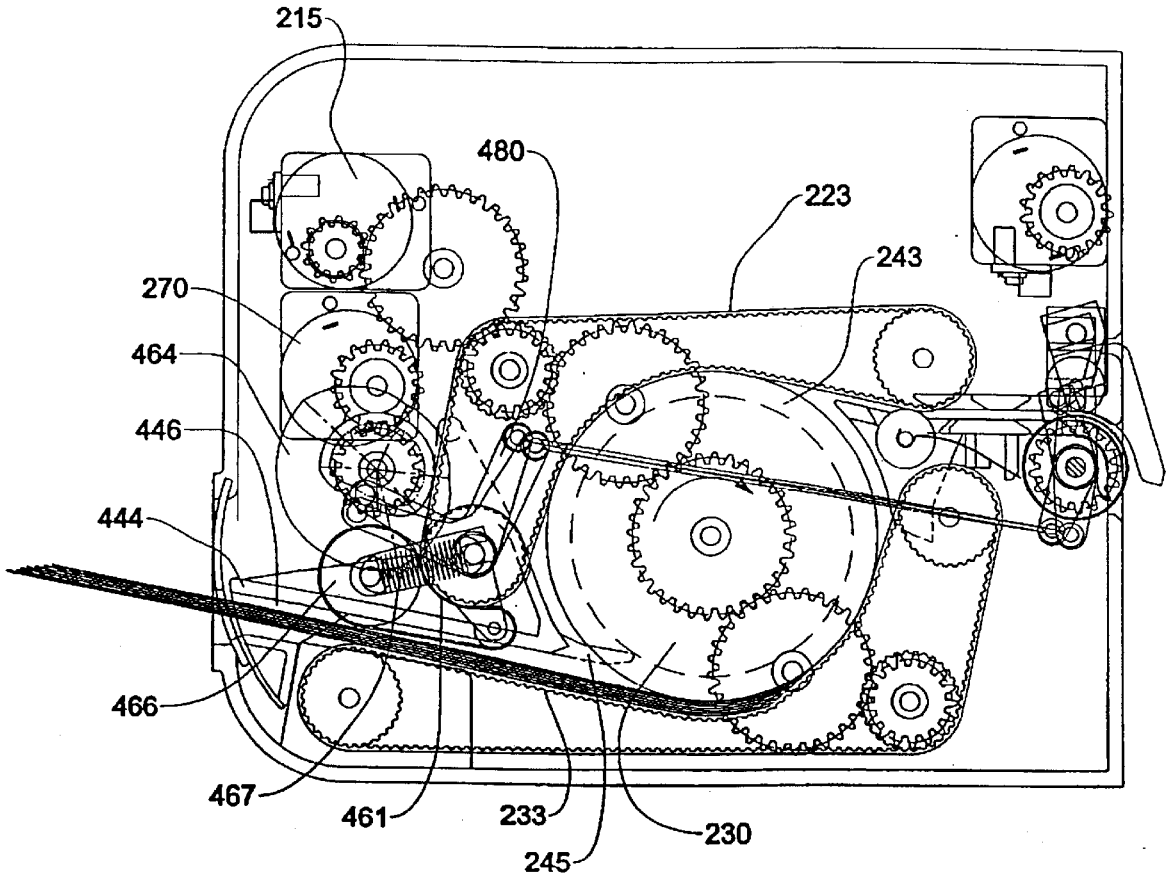
FIG. 14 is a view similar to FIG. 13 with the accumulator dispenser dispensing a number of stacked banknotes.

FIGS. 12 through 14 show details of the banknote stacker used to dispense a stack of banknotes from the combination unit. The banknote stacker 2 in the embodiment of FIGS. 12 through 14, and the combination unit of FIG. 1, is designed to receive banknotes moving upwardly to the stacking arrangement along path 104. The stacker 2 includes a toggle 209 which has been moved to an intercept position and acts as a guideway for feeding a banknote into the stacker.

The stacker includes its own drive motor 215 which is a variable speed motor which is coordinated with the feed speed of a banknote moving along path 104 and entering the stacking unit. The motor 215 drives the initial gear 217 which drives gears 219 and 221, with gear 221 driving the drive belt 223. Gear 221 is also connected to drive gear 225 which is in mesh with gear 227 associated with shaft 227*a*. Gear 227 is also associated with gear 229 and gear 231 which drives the second drive belt 233. With this arrangement, each of the drive belts 223 and 233 are driven at the same speed and in synchronization with each other. Each of the drive belts 223 and 233 are in limited contact with different portions of the periphery of the accumulator 230. The accumulator is driven by the drive belts 223 and 233 and is freely rotatable on the shaft thereof. Banknotes are stacked on the outer rings 241 of the accumulator and the surface of the accumulator is recessed to define slots 243.

A banknote 260 is being driven upwardly along passage 104 towards the entrance 265 of the stacker. The speed of the banknote as it moves to the stacker is coordinated with the speed of the accumulator. In the embodiment of FIG. 12, there are no banknotes on accumulator 230 and the relative speeds are not particularly pertinent other than with respect to providing a smooth transition. As the banknote enters the stacker, it is driven in the pathway 104 and enters the stacker. Drive belt 223 and idler roller 263 engage the leading edge of the banknote and direct the banknote to the accumulator 230. The banknote becomes partially wrapped about the accumulator and remains partially wrapped about the accumulator due to the belt 223 pressing it against the accumulator and belt 233 subsequently pressing the banknote against the accumulator. As can be appreciated, during movement of a banknote into the stacking arrangement, the accumulator 230 is driven in a counter clockwise direction.

FIG. 13 is similar to the view of FIG. 12, however, a number of banknotes 400 have been partially wrapped about the accumulator 230. Note that the length of the banknotes is less than the perimeter of the accumulator 230 and a substantial gap 290 is defined between the leading edge 402 and the trailing edge 404 of the banknotes.

Note that in FIG. 13 a new banknote 405 has been brought into engagement with the previous stacked banknotes with the leading edge of the banknote 405 brought into the general alignment with the other leading edges 402. To achieve this synchronization, the speed of the banknote in the passageway 104 is known and coordinated with the position of the stacked banknotes on the accumulator, and the speed of the accumulator is adjusted to achieve the necessary alignment of a banknote being stacked with the previous stacked banknotes. Various sensors can be provided to achieve this synchronization.

In the embodiments of FIGS. 12 and 13, the accumulator is driven in a clockwise direction and the discharge opening 440 is closed by the blocking member 442. The blocking member 442 is on a pivoting lever 444 having a discharge passage 446 which is part of the lever.

FIG. 14 shows the discharge of stacked banknotes from the dispensing device. In this case, the lever 444 has been moved by the cam member 464 to align the discharge passage 446 with a continuation of one end of the drive belt 233. An end of the drive belt 233 cooperates with the additional drive belt 466 which is driven by and in sympathy with drive belt 223. The motor 215 is a reversible motor and is reversed such that the accumulator 230 is driven in a clockwise direction.

Lever 244 includes finger members 245 which engage the slots 243 of the accumulator 230. The initial discharge of the banknotes is coordinated with the position of the accumulator 230 such that the fingers 245 enter the gap between the trailing and leading edges and thus, the fingers 245 strip the trailing ends of the banknote which now become a leading edge during discharge of the banknotes. The fingers engaging the slots 243 ensures a smooth transition of the stacked banknotes from the accumulator to the gap between drive belt 233 and belt 466 with the stacked banknotes outputted through the discharge port.

With the dispensing unit of FIGS. 12 through 14, stacked banknotes are dispensed through a dispensing slot in a convenient manner for the user. The accumulator 230 during a loading operation, is normally continuously driven and the speed thereof is appropriately adjusted to marry with the speed of a banknote being received. This is a more or less continuous motion operation and is relatively fast. This action has been found to be more efficient than a stop/start type action. The device is reversible and when reversed allows dispensing of the stacked banknotes.

Various sensors can be provided for detecting the leading or trailing edges of the banknotes. An important point to note with the arrangement is that banknotes are stacked one on top of the other and are preferably aligned. More importantly, there is a gap between the stacked banknotes exposing a portion of the accumulator to allow the fingers 245 to assume a position where stripping of the banknotes during discharge is positively provided.

Figure 15:
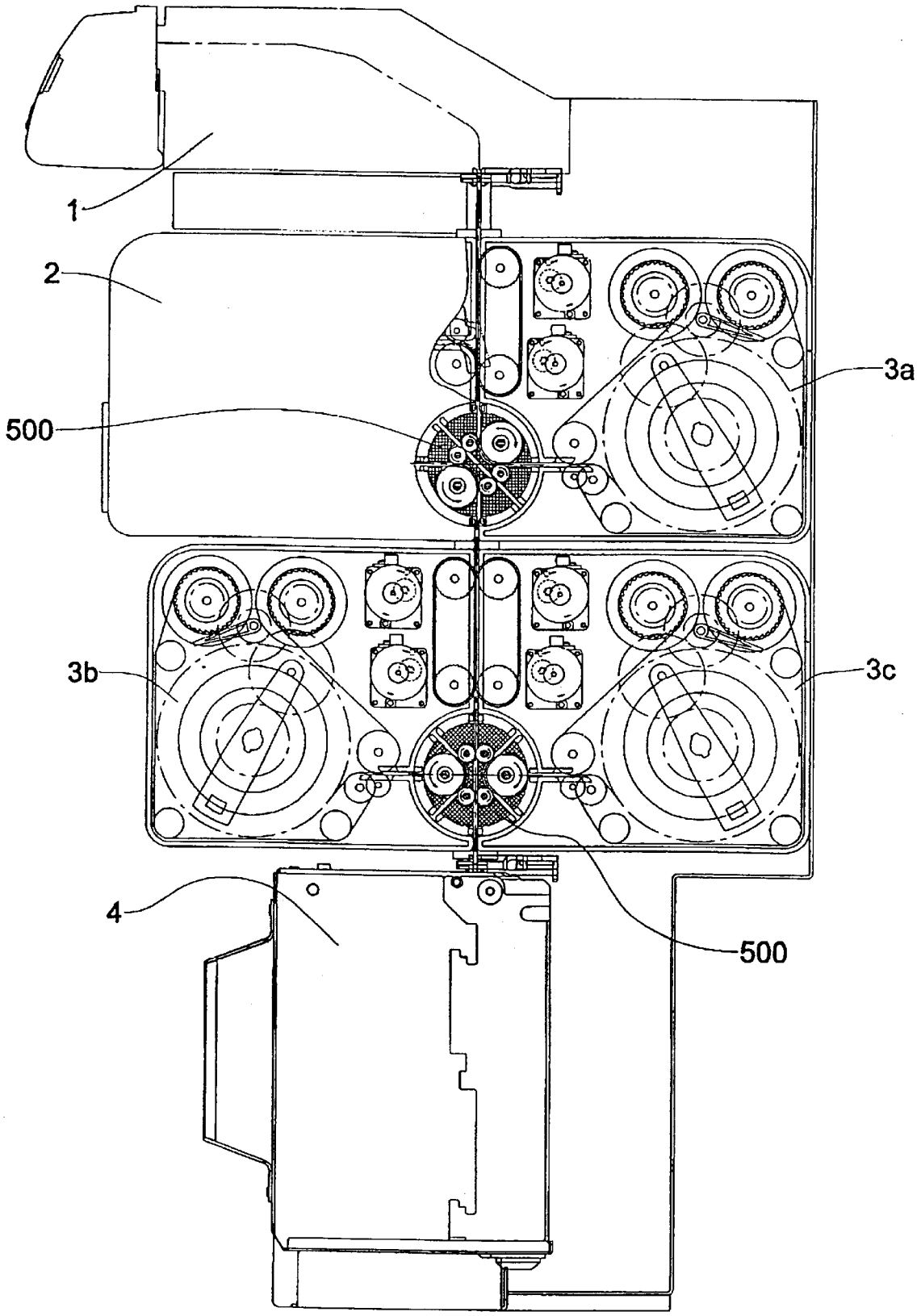
FIG. 15 is a partial vertical sectional view showing details of three accumulators and one dispensing unit positioned between the validator and the banknote cassette.

FIG. 15 shows a first alternate embodiment to the invention. In this case, the dispensing unit 2 remains essentially unchanged and the accumulating units have drive belts along passage 104 for driving of banknotes through the device for appropriate processing. The drive motor for the drive belts along pathway can be part of the combination unit and connected by a gear train to the drive belts. Each of the accumulators and the dispensing unit have a semi circular recessed portion opening onto passage 104 for accommodating the rotary switch member 500. Two such rotary switch members are shown in FIG. 15.

Each rotary switch 500 defines three different pathways for processing of a banknote. The upper rotary switch 500 of FIG. 15 cooperates with passage 104 to direct a received banknote in passageway 104 to the accumulator 3*c*. The lower rotary switch 500 is positioned to allow a banknote to pass by each of the accumulators 3*b* and 3*c* for feeding into the banknote cassette 4. Details showing modification of the accumulators are shown in FIGS. 16 and 17.

Figure 16:
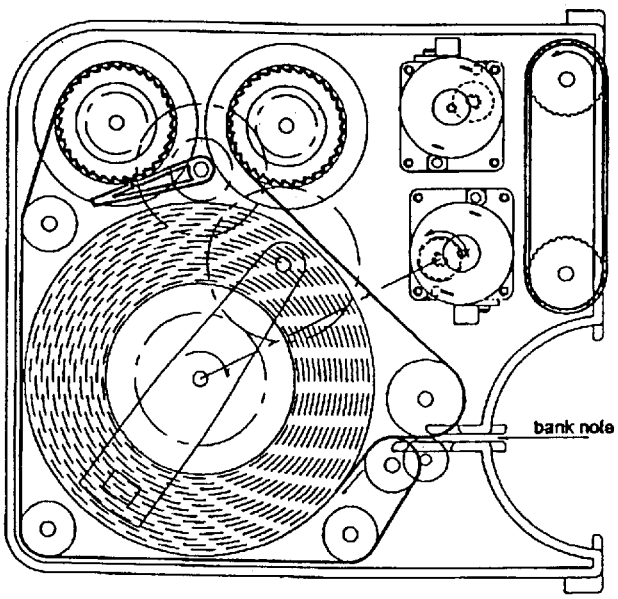
FIG. 16 is a sectional view through one of the accumulators showing winding of the banknotes.

In FIG. 16, a banknote is about to be received into the accumulator and the banknote being received would be driven by either the belt drive of that accumulator or the belt drive of an accumulator located below. The wrapping of the banknote about the storage spool and between the belts remains essentially the same.

Figure 17:
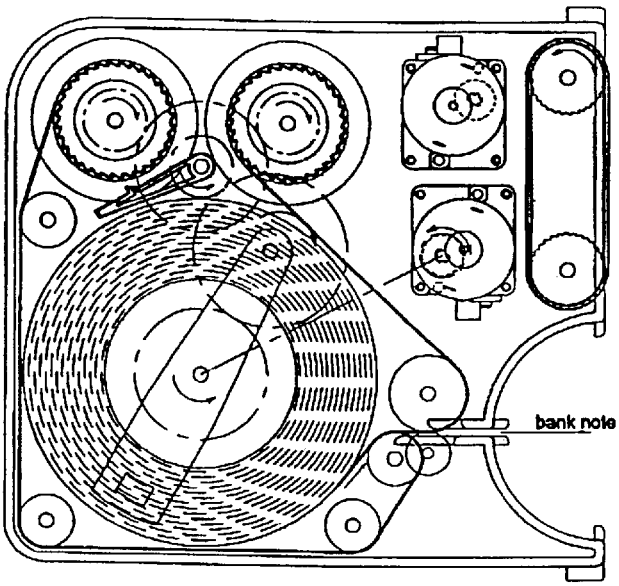
FIG. 17 is a view similar to FIG. 16 with the accumulator positioned for outputting of a banknote.

In FIG. 17, the banknotes are being dispensed and being discharged from the device. This embodiment reduces the number of toggle members entering the passage member 104 and more positively, directs the banknote into a device or out of a device and conveniently allows transfer across the device.

Figure 18:
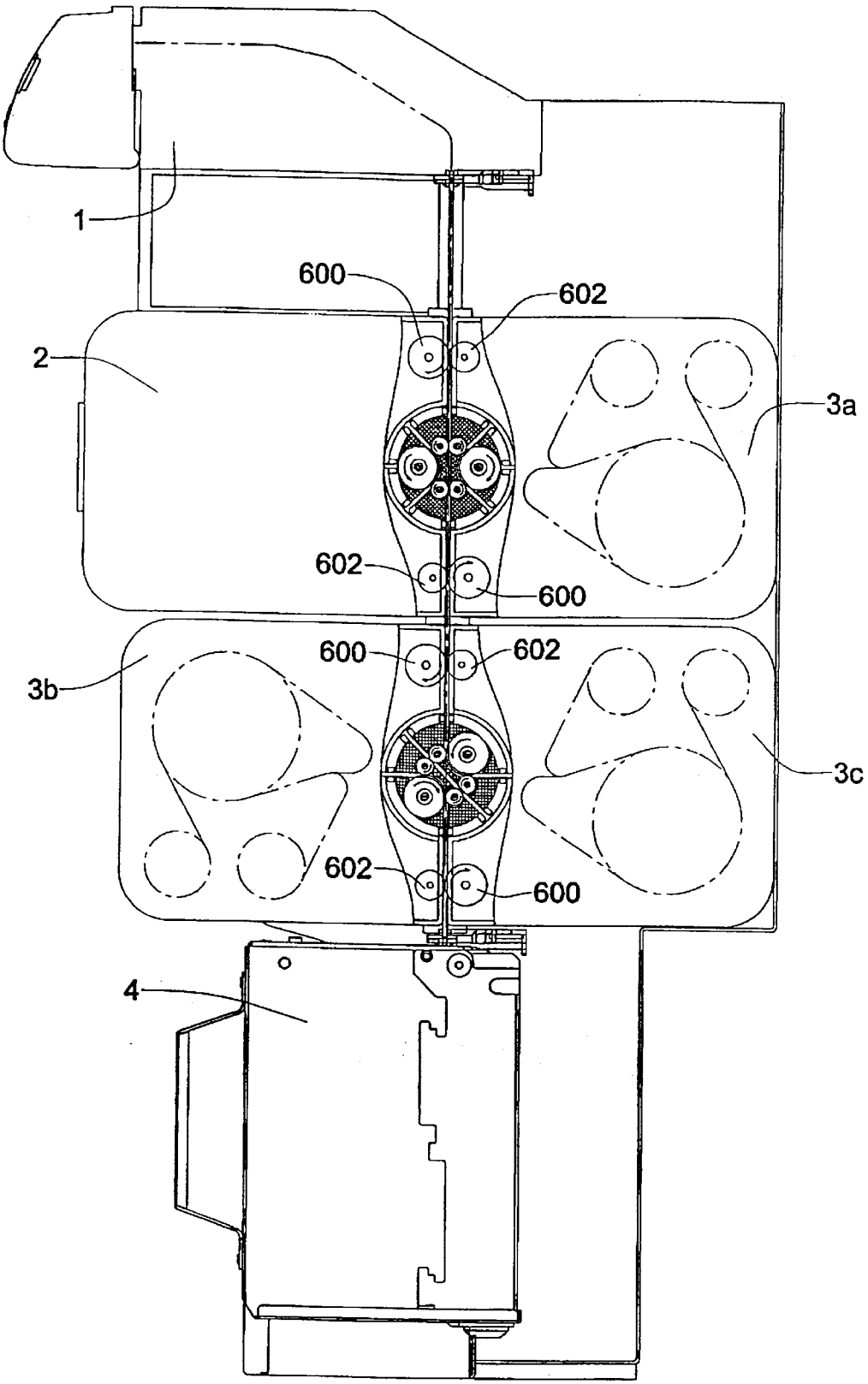
FIG. 18 shows a modified combination unit with a rotary member directing banknotes received by the validator to the various devices of the combination unit according to the position of the switch.
Figure 19:
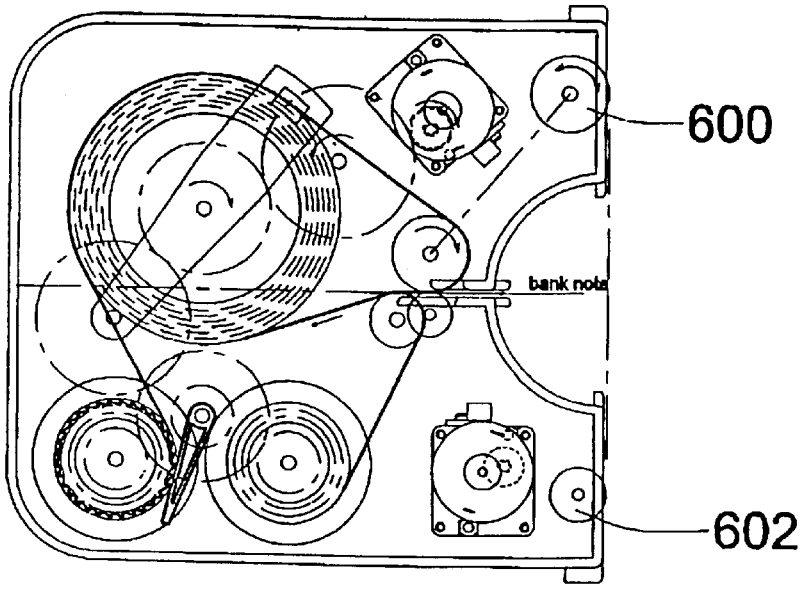
FIG. 19 is a view of a modified accumulator with a centre input position for receiving of a banknote.
Figure 20:
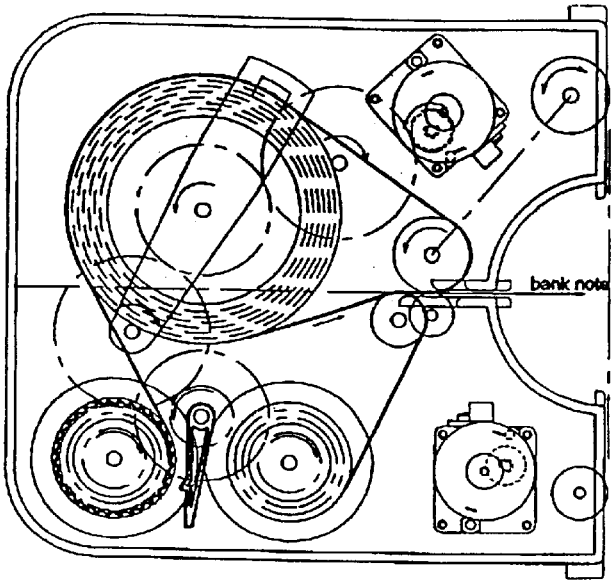
FIG. 20 is a view similar to FIG. 19 with the accumulator dispensing a previously received banknote.

FIGS. 18, 19 and 20, show yet a further modification or variant of the design where the accumulators cooperate with a rotary switch which is centrally located relative to the accumulating devices. In this embodiment, the accumulator includes a gear train that drives the drive wheel 600 in one of two directions and this drive wheel cooperates with an idler wheel 602 of a different device located on the opposite side of the passageway. This gear train is connected to a motor associated with the combination unit which also drives the gear train of the opposed accumulator. In this way the speed of the drive belts are maintained in synchronization.

As can be seen in FIG. 18, the accumulator 3*b* is rotated 180 degrees in the vertical plane to take the position of the accumulator 3*c* on the opposite side of the pathway. In this way, the accumulator construction remains unchanged and the accumulator can be used on opposite sides of the pathway 104.

Details of the rotary switch are shown in FIG. 21 through FIG. 28.

Figure 21:
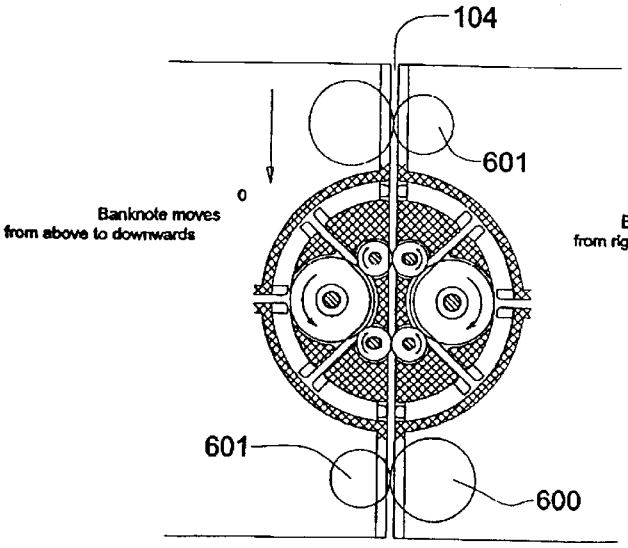
FIG. 21 shows the rotary member providing a straight through path between two units.

In FIG. 21, the banknote moves along pathway 104 between two devices and is driven by the drive rollers 600 which are in contact with idler wheels 601. A banknote moving downwardly along pathway 104 would pass directly through the rotary switch of FIG. 1.

Figure 22:
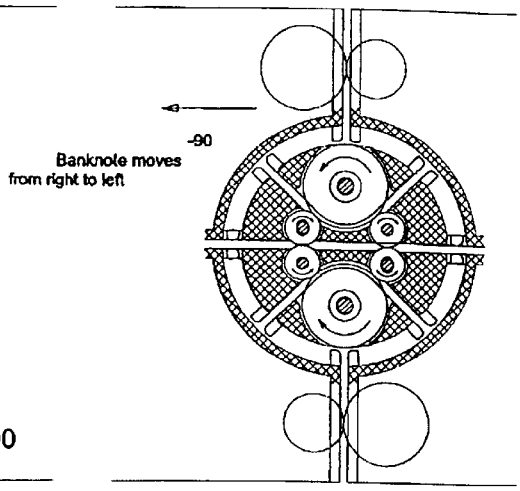
FIG. 22 shows the rotary member positioned for allowing a banknote to go from one device to an oppositely located device.

In FIG. 22, the rotary switch has moved 90 degrees and a banknote can now move from one accumulator to another accumulator if accumulators are on opposite sides of the pathway or from an accumulator to a stacker. Thus, banknotes are moved perpendicularly across pathway 104.

Figure 23:
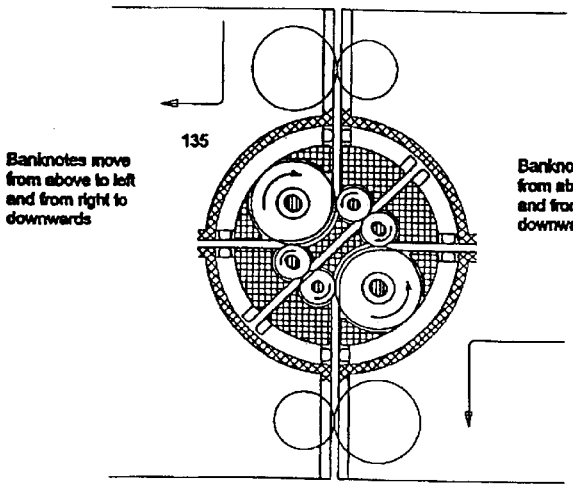
FIG. 23 shows the rotary member positioned for moving a received banknote to the right or for processing a banknote on the right downwardly.

In FIG. 23, the rotary switch now allows banknotes to move from above to the left, and from below to the right.

Figure 24:
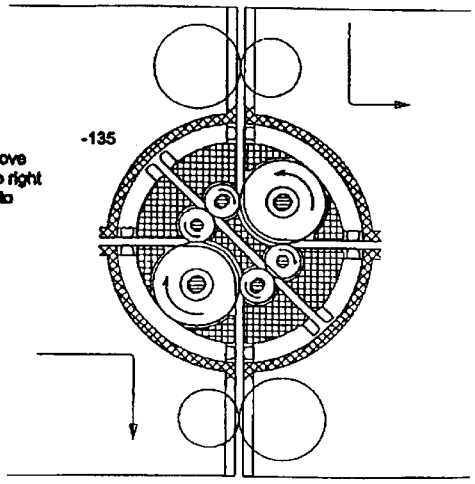
FIG. 24 shows the rotary member for moving a banknote from the left downwardly or from the top to the right.

In FIG. 24, banknotes moves from above to the right and from the left, downwards.

Figure 25:
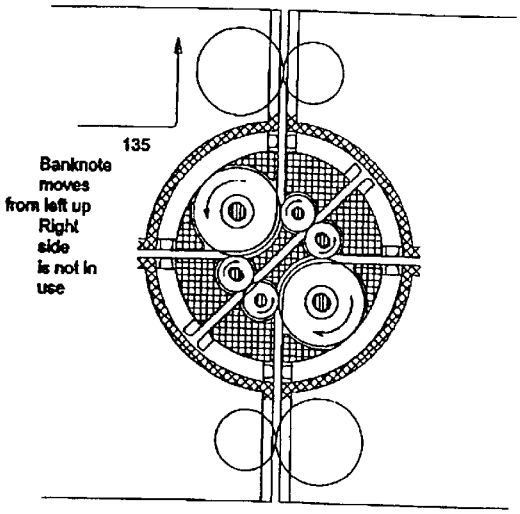
FIG. 25 shows yet a further position of the rotary member for moving a banknote from the left up.

In FIG. 25, banknotes move from the left up, and the right side is not in use.

It can be seen in FIG. 18 that the rotary switch is essentially of a three piece component having two drive wheels 700 and 702 for engaging a banknote and moving the banknote along a pathway involving a perpendicular transition. These wheels also engage idler wheels 704 which assist in moving a banknote through the switch device along the center passageway. These components can be held together in a spring retention member and basically move within the cylindrical cavity defined between two opposed accumulators or an opposed accumulator and a dispensing device.

A simplified drive train is also shown. In this case, a drive train is shown whereby the speed of the banknote along the pathway is coordinated from one device to the other. The drive can be associated with a common motor associated with the rotary switch for driving the center gear 710. The drive train provides the power to the drive rollers of each device or module.

Figures 26, 27:
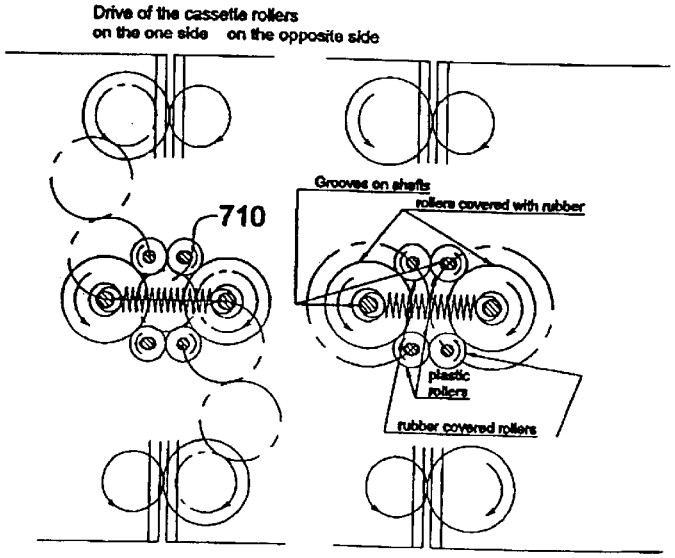
FIG. 26 shows a gear drive train arrangement associated with the rotary switch.
FIG. 27 shows various drive rollers driven by the rotary switch.
Figure 28:
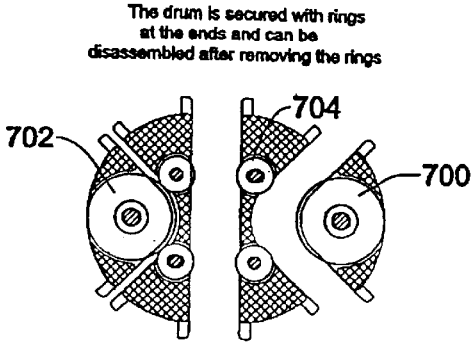
FIG. 28 shows the construction of the switched member.

FIG. 27 merely shows the cooperation of the various drive elements.

Figure 29:
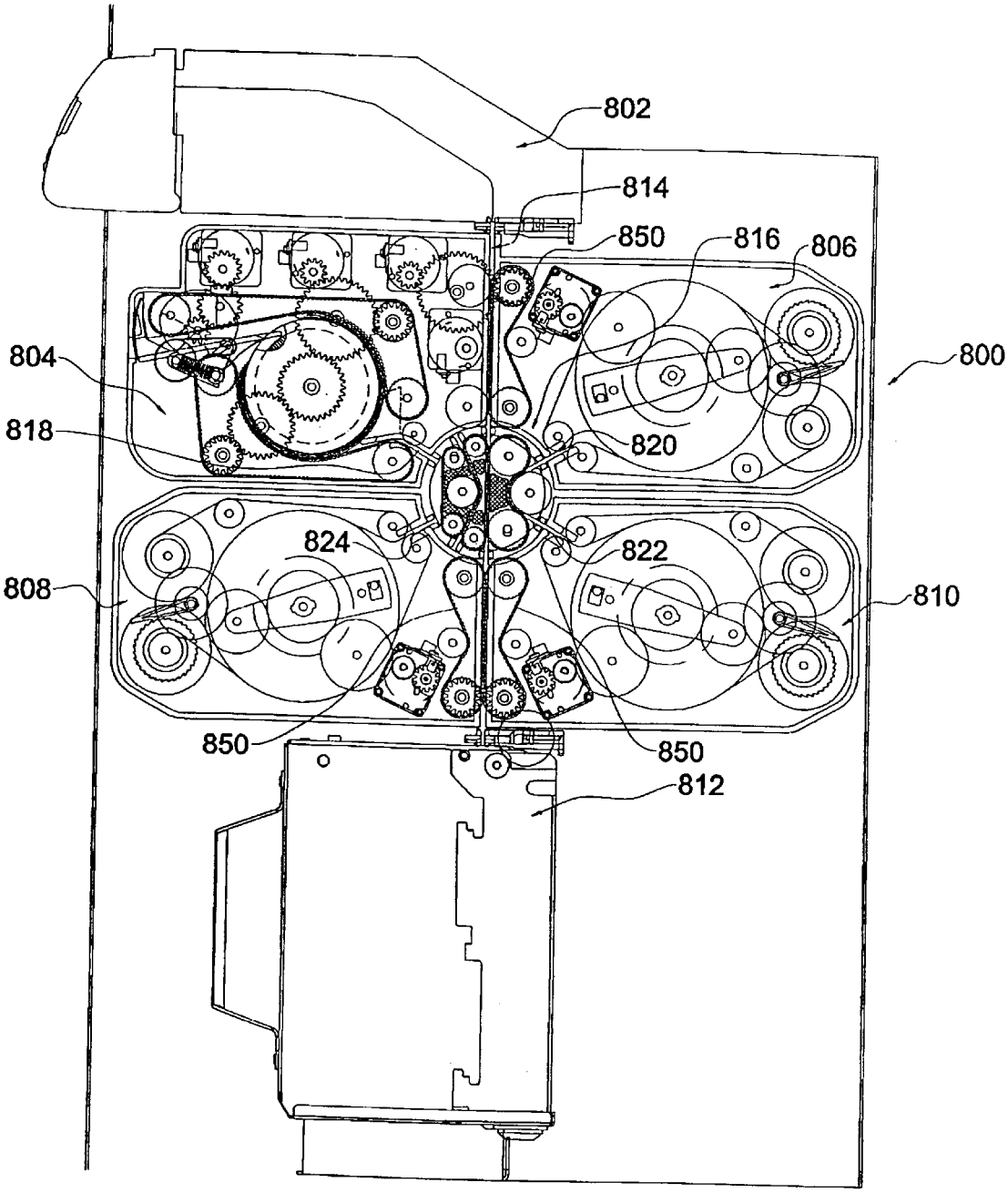
FIGS. 29 and 29*a* are partial sectional views of an alternate combination unit.
Figure 29A:
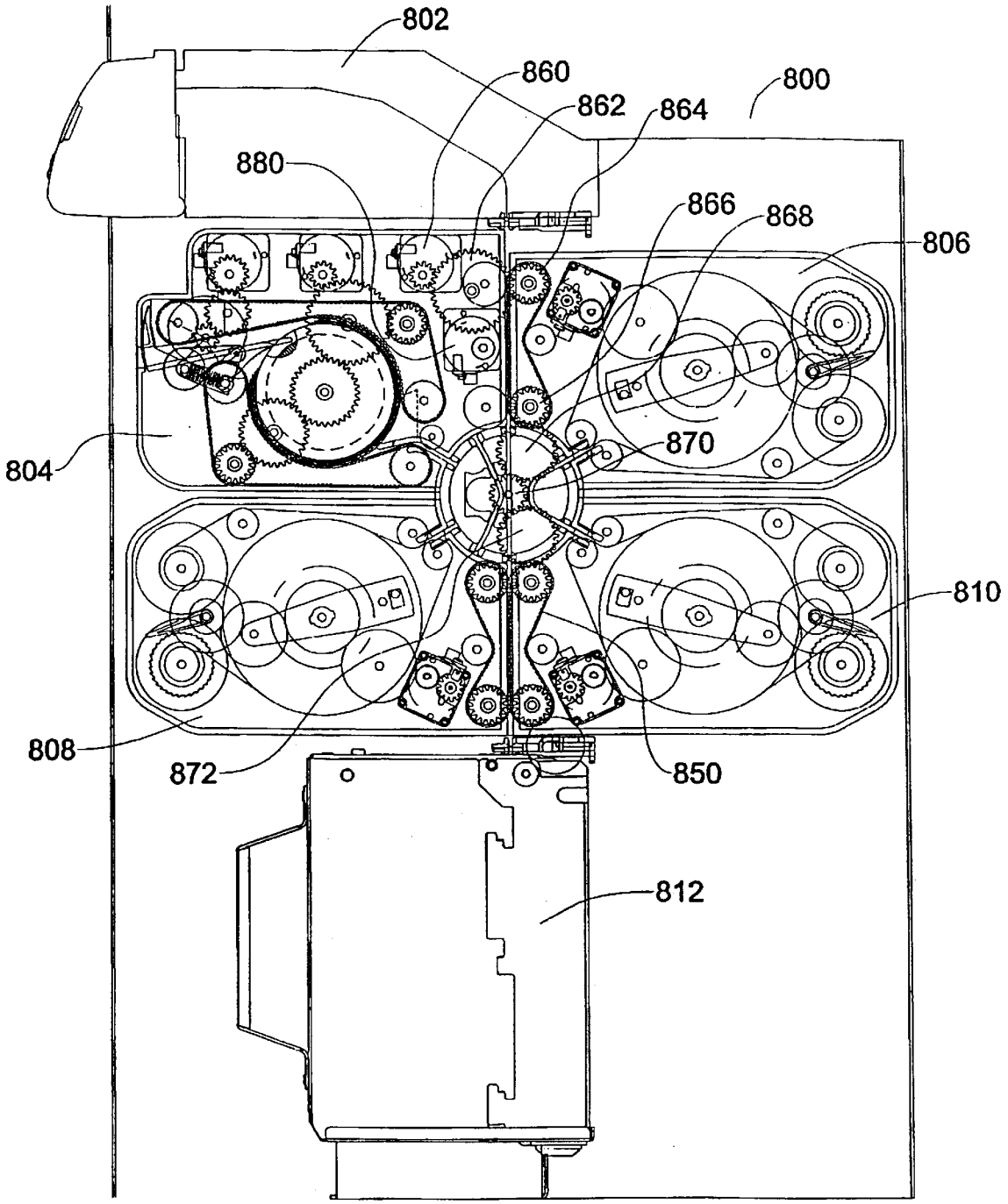
Figure 30:
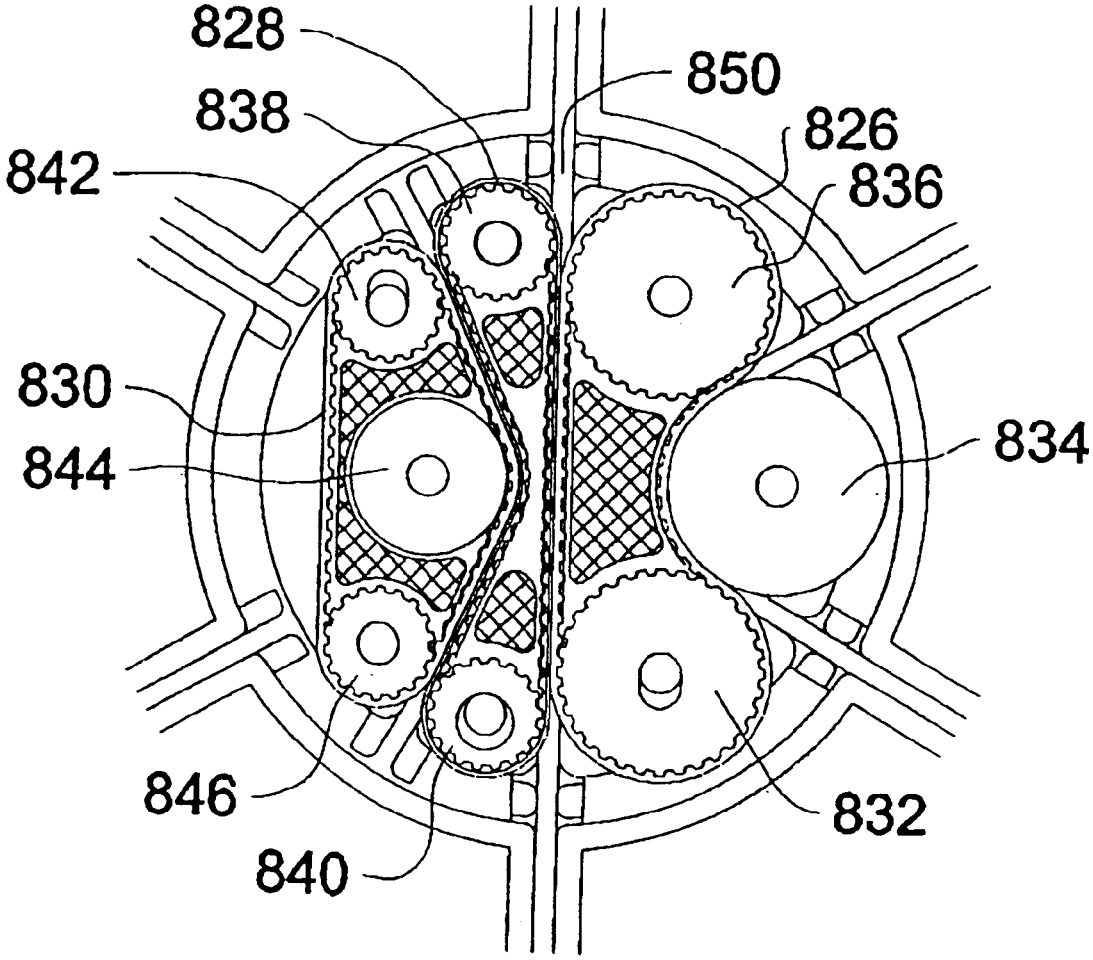
FIG. 30 is an enlarged view of the rotary switch used in the alternate combination unit.

An alternate construction is shown in FIGS. 29,29*a* and 30. The combination unit 800 includes a validator 802, a banknote dispenser 804, three banknote accumulators 806, 808 and 810, and a banknote storage cassette 812. A banknote processing pathway 814 connects the validator with the various components.

The modular components including the banknote dispenser 804 and the banknote accumulators 806, 808 and 810 are clustered around the rotary switch assembly 816. The entry point to each modular component is in a circular recess provided at a corner of each module. The entry point relative to a horizontal line through the rotary switch is 30 degrees above this horizontal line for each of the upper modules and 30 degrees below this horizontal line for the lower modules. Entry angles 818,820, 822, and 824 are shown. The upper modules require a 60 degree transition from the pathway 814 for entering either module while the lower modules each require a 120 degree transition. The rotary switch also allows a banknote to pass through the switch to enter the banknote cassette 812. The 60 degree transition also allows connection of modules stacked one above the other either on the left hand or right hand side of the pathway. The 120 degree transition allows connection between horizontally aligned modules upper or lower modules.

The rotary switch as shown in FIG. 30 includes 3 drive belts namely belts 826, 828 and 830. Belts 826 and 828 cooperate to define the straight through path 832. This path is vertically disposed in FIG. 29. Belt 826 is trained about rollers 832 and 836 and pushed inwardly by roller 834. The gap between rollers 832 and 834 and the gap between roller 834 and 836 collectively define the 60 degree transition.

Drive belt 828 is trained about rollers 838 and 840 and cooperates with belt 830 to define the 120 degree transition. Drive belt 830 is trained about rollers 842, 844 and 846.

As shown in FIG. 29*a,* a single drive motor 860 drives gear 862 which is in mesh with gear 864, which drives the belt 850 associated with accumulator 806. Gear 866 is driven by belt 850 and is in mesh with gear 868, which is in mesh with gear 870. This gear drives gear 872 which, via gears 866 of each of the lower accumulators 808 and 810, drives the belts 850 of the lower accumulators. This gear train arrangement allows the single motor 860 of the dispenser 804 to drive the banknotes along the processing pathway.

The belts of the rotary switch are preferrably driven by the same motor. A separate gear train associated with gear 870 can appropriately drive the belts at the same speed.

The motor 880 controls the position of the rotary switch 816. The rotary switch is moved to the appropriate position for transfer of a banknote to or from the pathway. The belts within the switch positively feed a banknote and avoid problems associated with jamming. Although drive belts have been described drive rollers could also be used. The rotary switch in combination with the angled entryway to the modules is space efficient, uses less parts, and allows sharing of the drive motor 860. In this alternate embodiment, the accumulators 806, 808 and 810 have a single drive motor, as opposed to two drive motors per accumulator of earlier embodiments.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A combination bill validator, bill accumulator bill dispensing unit, said combination comprising a validator for receiving banknotes and evaluating banknotes and forwarding accepted banknotes to a processing pathway, and a series of modular components which cooperate to define said banknote processing pathway therebetween; said series of modular components including a banknote accumulator for receiving and temporarily storing received banknotes and outputting received banknotes to said processing pathway, a removable banknote cassette for receiving and storing banknotes in a stacked manner, and a banknote dispenser which receives banknotes from said pathway and discharges received banknotes through a discharge port; and wherein said processing pathway is defined by at least some of said modular components and at least one of said modular components includes a drive arrangement located in said pathway for engaging and driving a banknote along said pathway.

2. A combination unit as claimed in claim 1 wherein said modular components are located in opposed pairs of modular components with said pathway therebetween and each modular component includes a drive arrangement which cooperates with the drive arrangement of the opposed module to drive a banknote along said processing pathway.

3. A combination unit as claimed in claim 2 wherein said modular components each include an additional banknote drive for driving a banknote received within said modular component.

4. A combination unit as claimed in claim 3 wherein said banknote dispenser is located opposite said banknote accumulator with said processing pathway therebetween, and said series of modular components include two additional banknote accumulators in opposed relationship and defining said pathway therebetween.

5. A combination unit as claimed in claim 4 wherein said banknote cassette is separated from said validator by said banknote accumulators and said banknote dispenser.

6. A combination unit as claimed in claim 5 wherein said combination unit includes a separate controller and processing arrangement and wherein said modular components are all controlled by said separate controller and processing arrangement.

* * * * *